US007504773B2

(12) United States Patent
Okawa et al.

(10) Patent No.: US 7,504,773 B2
(45) Date of Patent: Mar. 17, 2009

(54) PLASMA DISPLAY PANEL HAVING A GAS ADSORPTION MEMBER

(75) Inventors: Masafumi Okawa, Suita (JP); Hiroyuki Kado, Ibaraki (JP); Yoshiki Sasaki, Shijonawate (JP); Masaki Nishinaka, Mino (JP); Kazuya Hasegawa, Takatsuki (JP)

(73) Assignee: Panasonic Corporation, Osaka (JP)

( * ) Notice: Subject to any disclaimer, the term of this patent is extended or adjusted under 35 U.S.C. 154(b) by 513 days.

(21) Appl. No.: 10/524,885

(22) PCT Filed: May 14, 2004

(86) PCT No.: PCT/JP2004/006885

§ 371 (c)(1),
(2), (4) Date: Feb. 16, 2005

(87) PCT Pub. No.: WO2004/102606

PCT Pub. Date: Nov. 25, 2004

(65) Prior Publication Data

US 2006/0132037 A1 Jun. 22, 2006

(30) Foreign Application Priority Data

May 19, 2003 (JP) ..... 2003-140167

(51) Int. Cl.
*H01J 17/24* (2006.01)
*H01J 11/02* (2006.01)

(52) U.S. Cl. ..... 313/582; 313/493; 313/484; 445/25

(58) Field of Classification Search ..... None
See application file for complete search history.

(56) References Cited

U.S. PATENT DOCUMENTS

| | | | | |
|---|---|---|---|---|
| 5,012,102 | A * | 4/1991 | Gowlett | 250/352 |
| 5,519,284 | A * | 5/1996 | Pepi | 313/495 |
| 6,039,620 | A * | 3/2000 | Itoh et al. | 445/25 |
| 6,313,579 | B1 * | 11/2001 | Nakano et al. | 313/493 |

FOREIGN PATENT DOCUMENTS

| | | |
|---|---|---|
| JP | 4-269425 | 9/1992 |
| JP | 07296748 A * | 11/1995 |
| JP | 10-334816 | 12/1998 |
| JP | 2003-22744 | 1/2003 |

OTHER PUBLICATIONS

[Gas Discharge Panel] IBM Technical Disclosure Bulletin, Jun. 1974, pp. 284-285.*
International Search Report corresponding to application No. PCT/JP2004/006885 dated Aug. 24, 2004.
Hiraki Uchiike et al., "All about Plasma Display", pp. 79-80 and 102-105.

* cited by examiner

*Primary Examiner*—Sikha Roy
(74) *Attorney, Agent, or Firm*—RatnerPrestia

(57) ABSTRACT

A plasma display panel including a gas adsorption member is disclosed. An effort of gas adsorption is obtained sufficiently, and the presence of the gas adsorption member avoids problems at an exhausting operation in exhaust-baking step. The plasma display panel includes a pair of plates opposed to each other with an enclosed discharge space in between. The pair of plates refer to a front plate and a back plate, and at least one of the plates has a communication hole, around which the gas adsorption member having a hole is disposed.

5 Claims, 7 Drawing Sheets

PLASMA DISPLAY PANEL HAVING A GAS ADSORPTION MEMBER

This Application is a U.S. National Phase Application of PCT International Application PCT/JP2004/006885.

TECHNICAL FIELD

The present invention relates to a plasma display panel known as a video display device featuring of large and thin in size and light in weight.

BACKGROUND ART

A plasma display panel (hereinafter referred to simply as "PDP") has drawn attention recently as a display panel excellent in visibility. The PDP can be grouped into AC-driven PDP and DC-driven PDP from the viewpoint of a driving method, or surface-discharge PDP and opposed-discharge PDP from the viewpoint of a discharge method. However, the present growing trend of higher resolution, larger screen and simpler fabrication makes the AC-driven and surface discharge PDP go mainstream.

The AC-driven and surface-discharge PDP comprises the following elements:

- a front plate including plural display electrodes formed of scan electrodes and sustain electrodes; and
- a back plate including plural data electrodes.

The front plate confronts the back plate with barrier ribs in between such that the display electrodes intersect with the data electrodes at right angles and a discharge space is formed therein. Discharge cells (a unit of emitting area) are formed at respective intersections of display electrodes and the data electrodes, and each one of the discharge cells includes a phosphor layer.

Application of a voltage between the display electrodes and the data electrodes generates discharge, and the phosphor layer is irradiated with ultraviolet rays resulting from the discharge, thereby producing visible light, which results in displaying a video.

In the steps of manufacturing the foregoing PDP, there is an exhaust-baking step for exhausting impurity gas outside a PDP. To be more specific, while a PDP is heated, the PDP is exhausted of air via an exhausting hole which is disposed on the back plate and communicates with the inside of the PDP. After this step, the discharge cells are filled with discharge gas. This procedure is disclosed at, e.g. pages 79-80, and pages 102-105 of "Everything about PDP" written by Messrs. Hiraki Uchiike and Shigeo Mikoshiba, and published from Industry Investigation Inc. on May 1, 1997.

A degasser (getter), i.e. gas adsorption member, is disposed in the vicinity of the exhausting hole for exhausting the PDP of air to a higher degree of vacuum in a shorter time, and the exhaust-baking step with the degasser results in more effective exhaust. In such a case, the degasser is placed in a space formed between the back plate and a pedestal of an exhausting pipe surrounding the exhausting hole. When the exhaust-backing step is carried out in the foregoing structure, the exhausting hole can be closed or clog with the degasser depending on a location of the degasser. As a result, the exhaust sometimes does not work functionally.

In case of such a trouble, the manufacturing operation of PDP must be temporarily halted, which causes an operation loss or reduces the yield because PDPs having insufficient degassing effect are produced.

The present invention addresses the problems discussed above, and aims to provide PDPs equipped with a degasser producing sufficient gas adsorption effort and free from problems at the exhaust-baking step.

DISCLOSURE OF THE INVENTION

The PDP of the present invention comprises the following elements in order to achieve the foregoing objectives:

- a pair of plates opposed to each other to form a discharge space in between, at least one of which plates includes a communication hole that communicates with the inside of the PDP; and
- a gas adsorption member having holes and being placed around the communication hole.

Since the gas adsorption member has holes, the PDP can be exhausted smooth regardless of a location of the gas adsorption member. As a result, quality PDPs are obtainable.

DESCRIPTION OF PREFERRED EMBODIMENT

Figure 1:
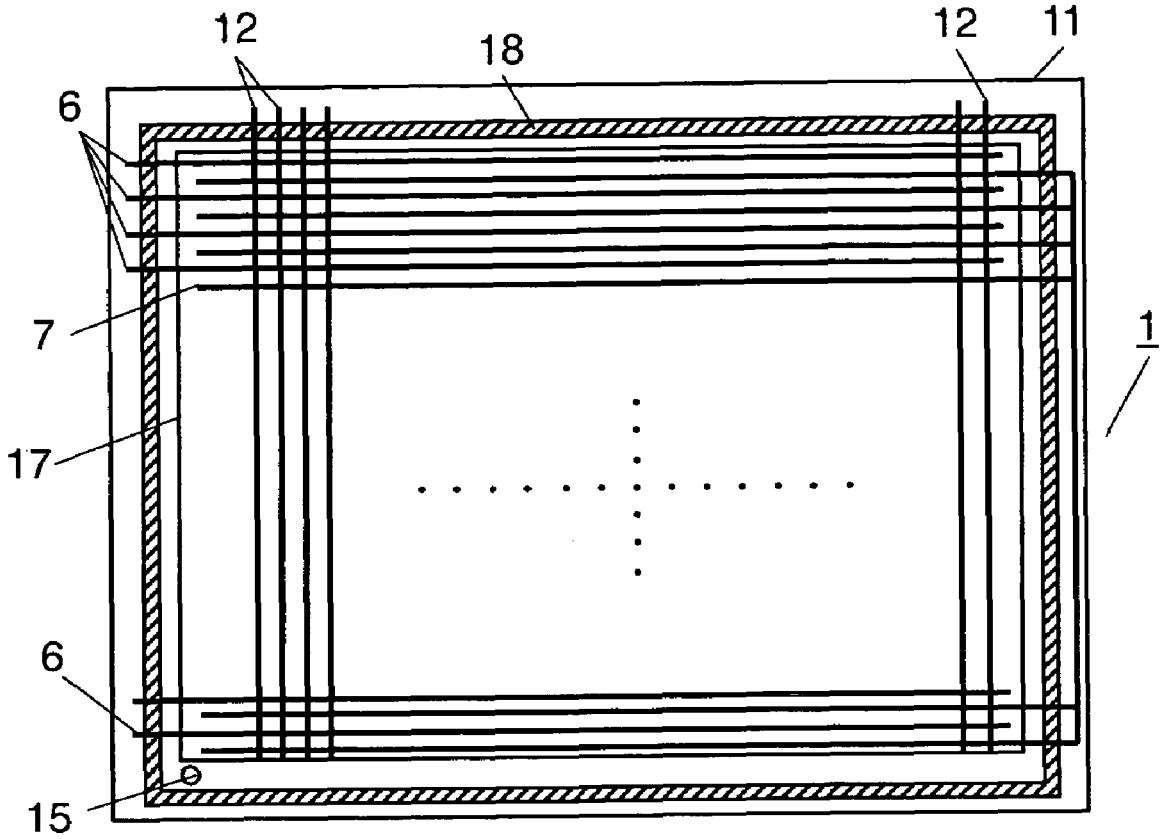
FIG. 1 shows a plan view illustrating a schematic structure of a PDP in accordance with an exemplary embodiment of the present invention.
Figure 2:
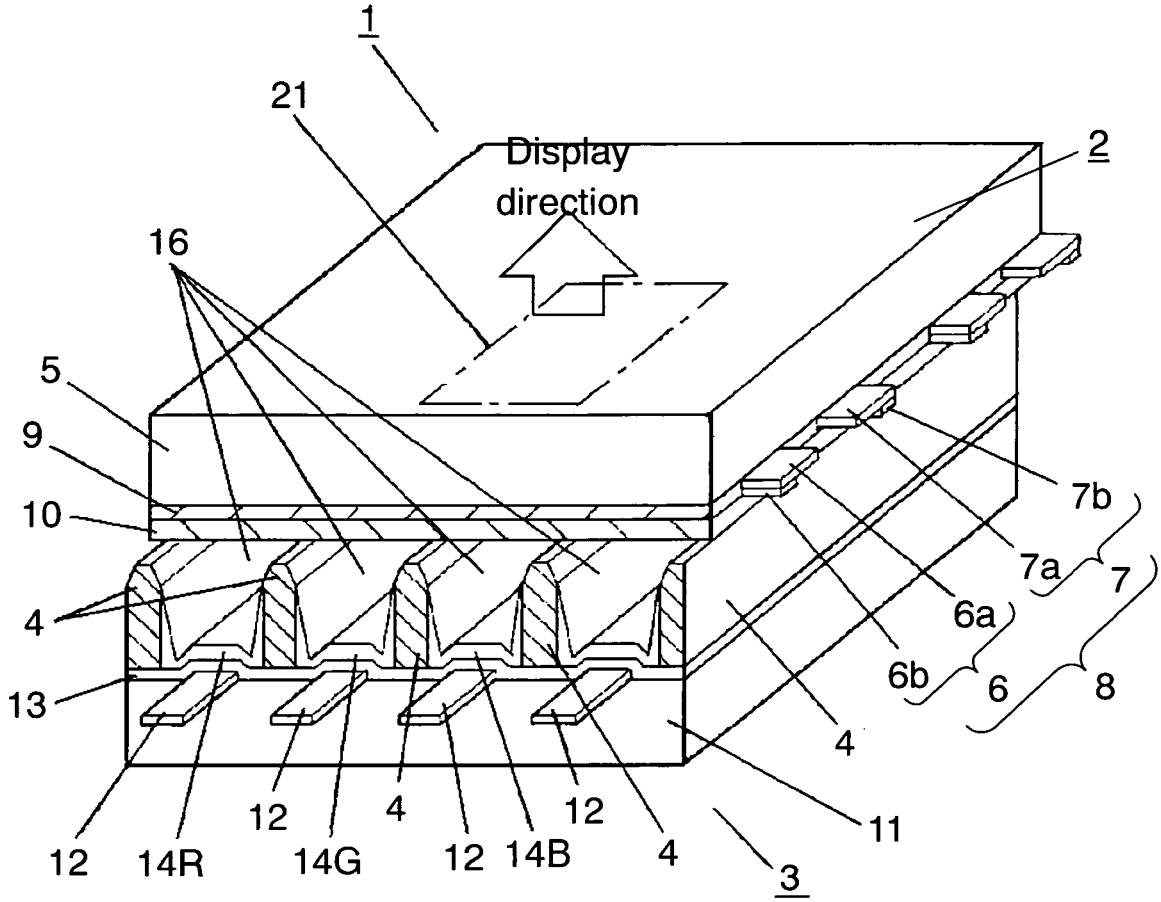
FIG. 2 shows a sectional perspective view illustrating a part of schematic structure of a display area of the PDP shown in FIG. 1.

An exemplary embodiment about a PDP of the present invention is demonstrated hereinafter with reference to the accompanying drawings. A structure of the PDP in accordance with the exemplary embodiment is described with reference to FIG. 1 and FIG. 2. FIG. 1 shows a plan view illustrating a schematic structure of the PDP in accordance with an exemplary embodiment of the present invention, and FIG. 2 shows a sectional perspective view illustrating a part of schematic structure of a display area of the same PDP.

PDP 1 includes front plate 2 and back plate 3 opposed to each other with barrier ribs 4 in between. Front plate 2 comprises the following elements:

- transparent and insulating glass substrate 5;
- display electrodes 8 placed on a principal plane of glass substrate 5 and formed of scan electrodes 6 and sustain electrodes 7;

dielectric layer 9 covering display electrodes 8; and protective layer 10 made of, e.g. MgO, and covering dielectric layer 9.

Scan electrode 6 and sustain electrodes 7 are formed by laminating bus electrodes 6*b* and 7*b* on transparent electrodes 6*a* and 7*a* respectively.

Back plate 3 comprises the following elements:

insulating glass substrate 11;

data electrodes 12 formed on a principal plane of glass substrate 11;

dielectric layer 13 covering data electrodes 12;

barrier ribs 14 formed on dielectric layer 13 at places corresponding to the places between data electrodes 12; and phosphor layers 14R, 14G and 14B in red, green and blue respectively and formed between barrier ribs 4.

The foregoing front plate 2 and back plate 3 are opposed to each other such that display electrodes intersect with data electrodes 12 at right angles and discharge space 16 is formed between the two plates with barrier ribs 4 therein. Those two plates are bonded and sealed with sealing member 18 at their periphery, i.e. outer area of video display area 17.

Discharge space 16 is filled with at least one of such rare gasses as helium, neon, argon, and xenon as discharge gas at a pressure of approx. 66500 Pa (500 Torr). The intersections of data electrodes 12 and display electrodes 8, which includes scan electrodes 6 and sustain electrodes 7, work as discharge cells 12 each of which is counted as a unit of light emission.

To be more specific, in each one of discharge cells 12 to be lit, cyclic applications of a voltage between display electrode 8 and data electrode 12 as well as between scan electrode 6 and sustain electrode 7 of display electrode 8 produces discharge. Ultraviolet rays resulting from the discharge energizes phosphor layers 14R, 14G and 14B, thereby producing visible light. Then a combination of lights and non-lights of respective discharge cells 12 allows displaying a video.

Figure 3:
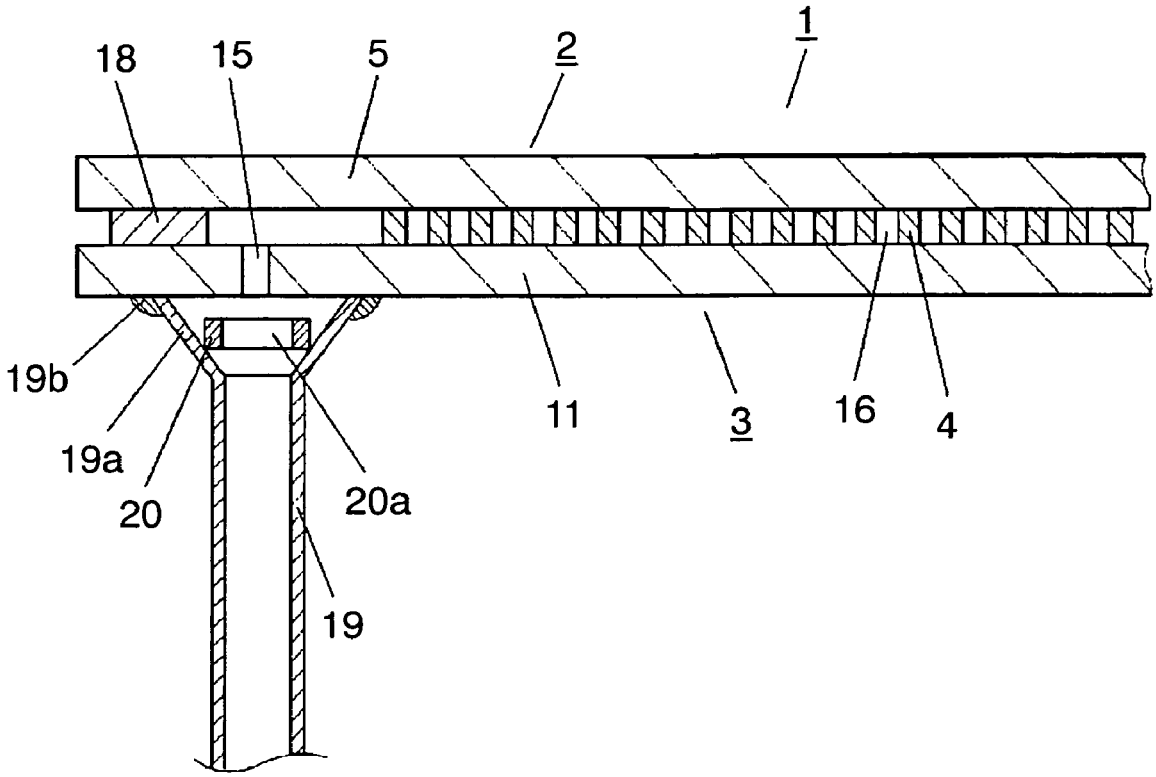
FIG. 3 shows a sectional view illustrating a schematic structure around a communication hole of the PDP shown in FIG. 1.

On the other hand, as shown in FIG. 1, glass substrate 11 of back plate 3 has communication hole 15 for exhausting discharge space 16 of air and filling discharge space 16 with the discharge gas. FIG. 3 shows a sectional view illustrating a schematic diagram around communication hole 15. As shown in FIG. 3, exhausting pipe 19 including pedestal 19*a* is bonded to substrate 11 with binding member 19*b* at the circumference of an exhausting hole, namely, communication hole 15. In a space formed between pedestal 19*a* and substrate 11, a degasser, i.e. gas adsorption member 20, is prepared. Gas adsorption member 20 is not rigidly placed but left movable within the space.

Figure 4:
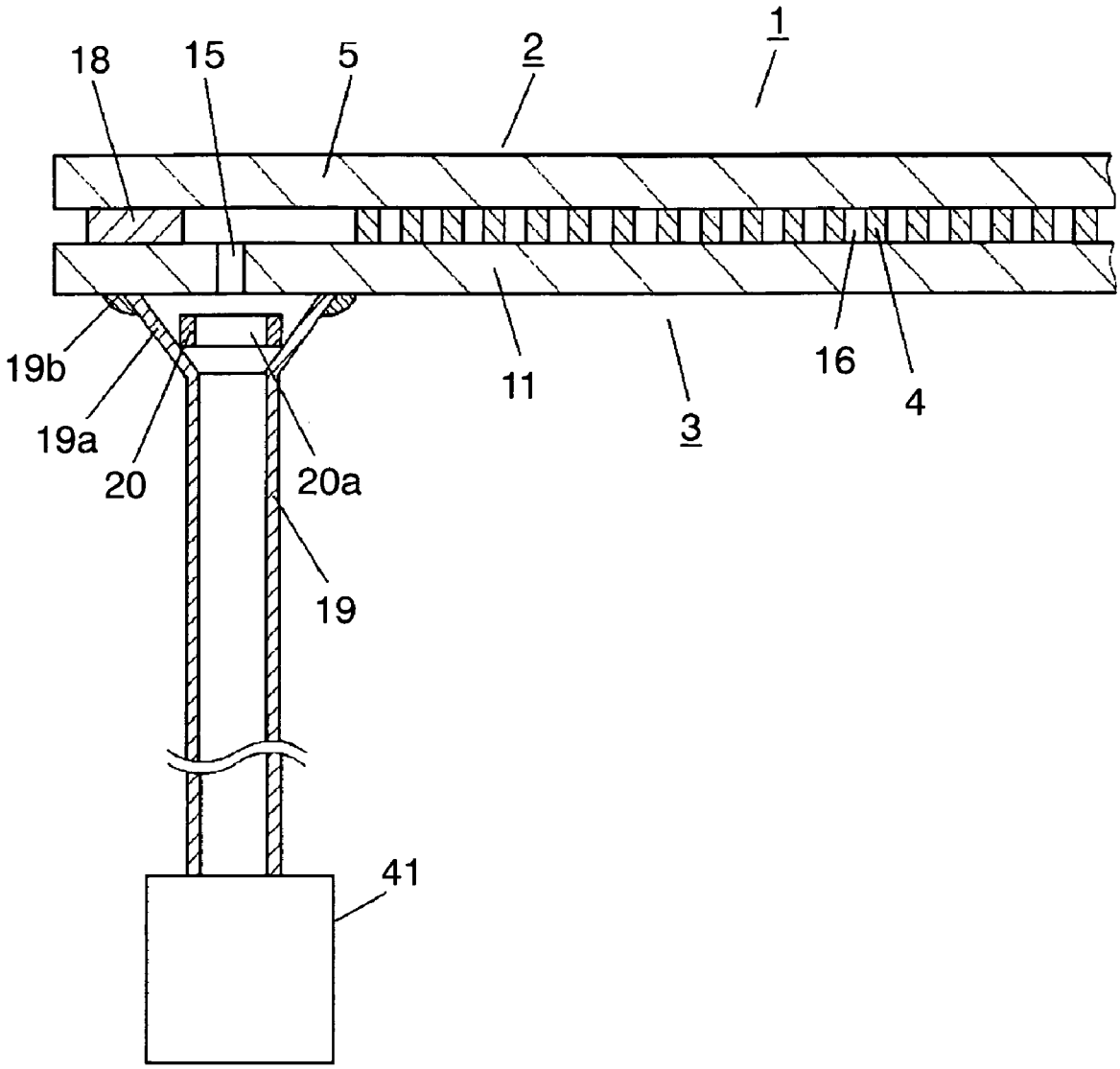
FIG. 4 shows a sectional view illustrating a schematic structure of a PDP undergoing an exhaust-baking step in accordance with an exemplary embodiment of the present invention.
Figure 5:
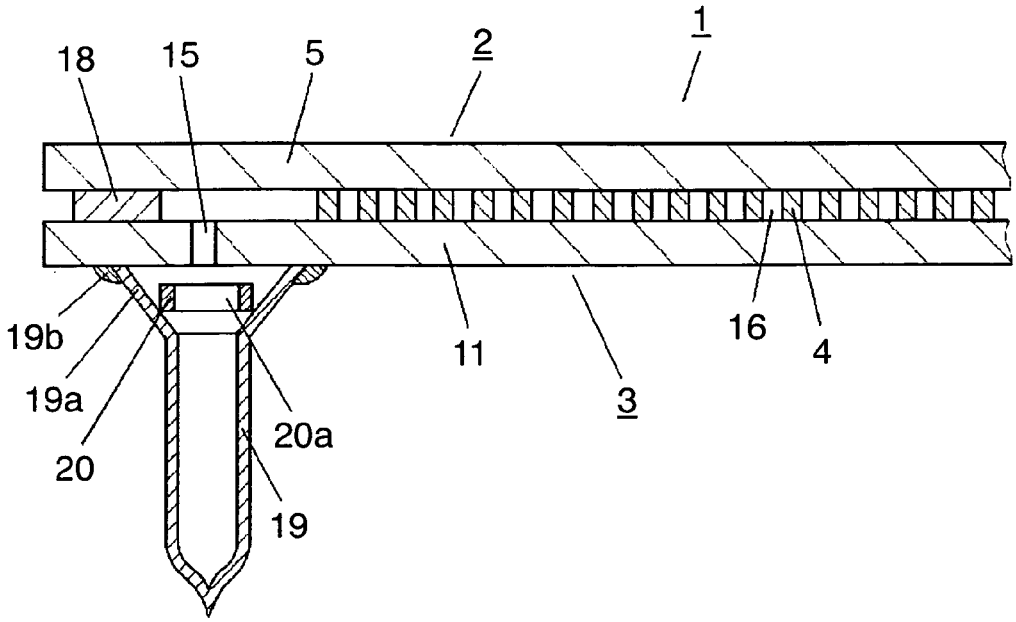
FIG. 5 shows a sectional view illustrating a schematic structure of the PDP sealed.

FIG. 4 shows a sectional view illustrating a schematic structure of an exhaust-baking step of manufacturing PDP 1. As shown in FIG. 4, exhausting pipe 19 is coupled to exhausting device 41 so that PDP 1 is exhausted of air into vacuum state. FIG. 5 shows a schematic structure illustrating PDP 1 sealed. As shown in FIG. 5, after exhaust-baking is completed, PDP 1 is filled with the discharge gas via exhausting pipe 19, then pipe 19 is sealed.

Figure 6:
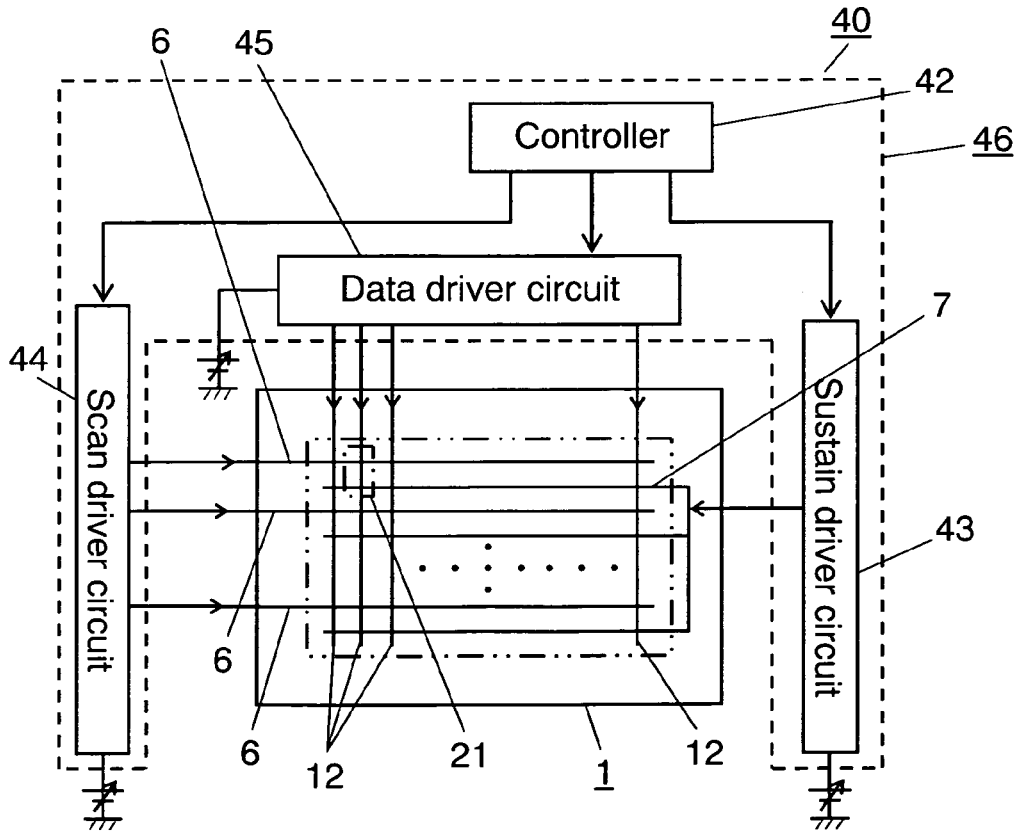
FIG. 6 shows a block diagram illustrating a schematic structure of a plasma video display device employing the PDP shown in FIG. 1.

FIG. 6 shows a block diagram illustrating a schematic structure of a plasma video display device employing the foregoing PDP 1. Plasma video display device 40 includes PDP 1 and PDP driver 46 coupled together. PDP driver 46 comprises controller 42, sustain driver circuit 43, scan driver circuit 44, and data driver circuit 45. In the case of driving plasma video displaying device 40, sustain driver circuit 43, scan driver circuit 44; and data driver circuit 45 are hooked up to PDP 1. Then a voltage is applied between scan electrode 6 and data electrode 12 at discharge cell 21, which is to be lit following the control of controller 42, for an address discharge to take place. After the address discharge, a voltage is applied between scan electrode 6 and sustain electrode 7, so that a sustain discharge takes place. This sustain discharge generates ultraviolet rays in this discharge cell 21, and phosphor layers 14R, 14G, and 14B (cf FIG. 2) are energized by the ultraviolet rays to emit light. Combination of lighting cells 21 and non-lighting cells 21 allows displaying a video.

In the manufacturing steps of PDP 1 discussed above, a pair of plates, namely, front plate 2 and back plate 3 opposed to each other, are bonded and sealed together. Then the sealed plates undergo the exhaust-baking step for exhausting PDP 1 of impurity gas. In this step, while being heated, PDP 1 is exhausted through communication hole 15 working as the exhausting hole. Then discharge gas is introduced, so that discharge cell 21 is filled with the discharge gas. As shown in FIG. 4, the exhaust-baking step exhausts PDP 1 of air to a vacuum condition with exhausting device 41 via communication hole 15 and exhausting pipe 19, and heats PDP 1. This step takes a rather long time among other steps of manufacturing PDP 1.

In this exemplary embodiment, a degasser, i.e. gas adsorption member 20, is disposed around communication hole 15 working as the exhausting hole. Gas adsorption member 20 is activated by the heat of the exhaust-baking step, and adsorbs the impurity gas in PDP 1. This structure allows achieving a desirable degree of vacuum of PDP 1 in a shorter time than the case where only exhausting device 41 exhausts PDP 1 of air. As a result, the exhausting time can be shortened and a lead-time of the manufacturing steps can be shortened.

On the other hand, as shown in FIG. 3, exhausting pipe 19 is bonded to substrate 11 with binding member 19*b* such that its pedestal 19*a* surrounds communication hole 15, i.e. the exhausting hole. The degasser, namely, gas adsorption member 20, is placed in the space formed by pedestal 19*a* and substrate 11. When the exhaust-baking takes place in the status shown in FIG. 4, gas adsorption member 20 smaller in size than the inner diameter of exhausting pipe 19 can clog pipe 19 or be sucked into exhausting device 41. In order to overcome those problems, the outer diameter of member 20 is set larger than the inner diameter of exhausting pipe 19, and hole 20*a* is disposed to member 20 as shown in FIG. 7. The foregoing structure allows pedestal 19*a* to regulate a location of gas absorption member 20 as shown in FIGS. 3 and 4, so that a possibility of pipe 19 clogging with member 20 is substantially reduced. Exhausting is carried out through hole 20*a* prepared in member 20, so that problems about the exhausting can be reduced.

Figure 7A:
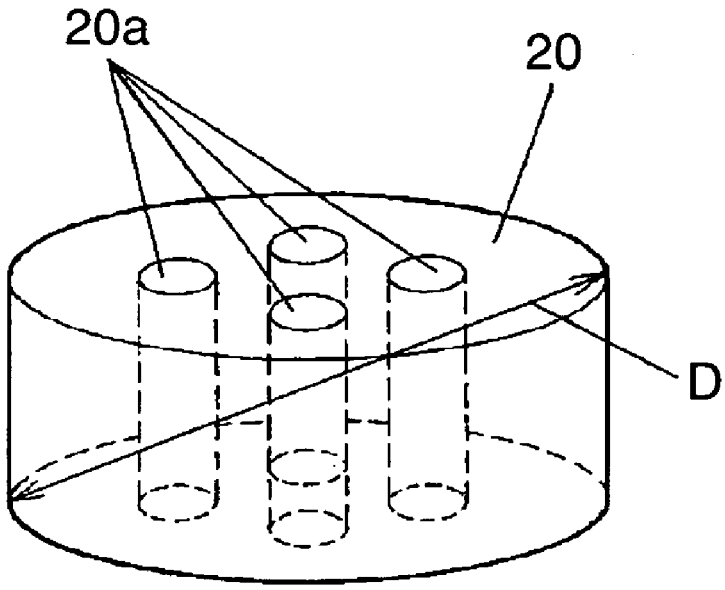
FIG. 7A shows a perspective view illustrating a shape of a gas adsorption member.
Figure 7B:
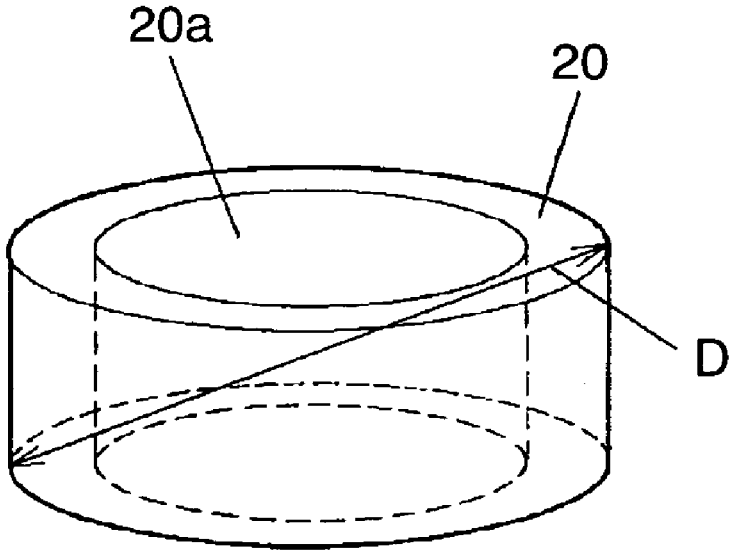
FIG. 7B shows a perspective view illustrating another shape of a gas adsorption member.

The size of gas adsorption member 20 refers to the maximum dimension of member 20, e.g. distance D of a diagonal line shown in FIG. 7B. The number of holes 20*a* and their shapes can be determined according to an actual structure, and a larger cross section area of hole 20*a* than the inner cross section area of pipe 19 can suppress a resistance against the exhausting. To be more specific, providing gas adsorption member with plural holes 20*a* as shown in FIG. 7A can increase the total area of holes 20*a* to a greater one than the inner cross section area of pipe 19, thereby suppressing the resistance against exhausting. In other words, in the case of preparing plural holes 20*a* as shown in FIG. 7A, the total cross section areas of holes 20*a* becomes larger than the inner cross section area of exhausting pipe 19, so that the resistance against the exhausting can be reduced.

Figure 8:
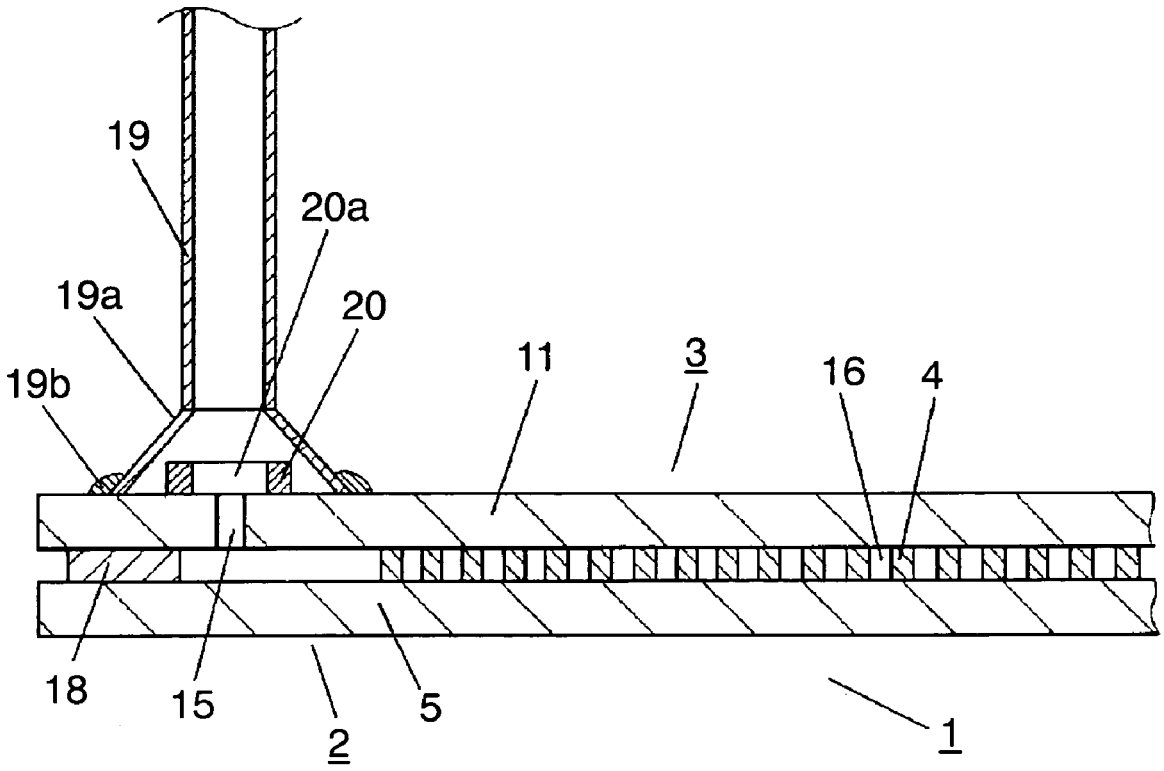
FIG. 8 shows a sectional view illustrating another schematic structure of a PDP undergoing an exhaust-baking step in accordance with an exemplary embodiment of the present invention.

In the case of carrying out the exhaust-baking with exhausting pipe 19 being held upward as shown in FIG. 8, gas adsorption member 20 greater in size than the inner diameter of the exhausting hole, i.e. communication hole 15, may clog communication hole 15 depending on a location of gas adsorption member 20. If communication hole 15 clogs with member 20, external exhausting device 41 slows down the exhausting, so that a given exhausting condition becomes difficult to hold. This problem can be also overcome by using adsorption member 20 having the structure shown in FIG. 7. To be more specific, gas adsorption member 20 is provided with hole 20*a*, and member 20 greater in size than communication hole 15 prevents itself from dropping into hole 15, and reduces the resistance against the exhausting. In the case of preparing plural holes 20*a* as shown in FIG. 7A, the total cross section areas of holes 20*a* becomes larger than the inner cross section area of exhausting pipe 19, so that the resistance against the exhausting can be reduced.

The foregoing structure of PDP 1 can be manufactured by the following method. PDP 1 having the construction shown in FIG. 4 undergoes the exhaust-baking. Sealing member 18 and biding member 19*b* employ glass frit of which melting point is 390° C. Glass substrate 11 is provided with communication hole 15 communicating with the inside of PDP 1 and working as the exhausting hole. Exhausting pipe 19 employs a glass tube having a thermal expansion coefficient similar to that of glass substrate 11, and includes pedestal 19*a*. Gas adsorption member 20 employs Zr-based material, or it can be made of Ti-based material. Member 20 shapes like a ring having an outer diameter smaller than the inner diameter of pedestal 19*a* but greater than the inner diameter of exhausting pipe 19. The inner diameter of the ring-shape, i.e. forming a hole, has an outer diameter greater than the inner diameter of communication hole 15 and that of exhausting pipe 19.

Then an end of exhausting pipe 19 is coupled to external exhausting device 41, and entire PDP1 is heated in a heating oven. Retaining PDP 1 at 450° C. for 20 minutes softens sealing member 18 and binding member 19*b*, then PDP 1 is cooled down to 350° C. for solidifying, so that PDP 1 is sealed again. After that, while PDP 1 is retained at 350° C. for two hours, exhausting device 41 starts exhausting PDP 1 of air into vacuum status, so that the exhaust-baking is carried out. Then PDP 1 is cooled down to an ambient temperature, and is filled with discharge gas formed of Ne (95%) and Xe (5%) at 67 kPa, thereby completing PDP1.

The steps discussed above prove that gas adsorption member 20 does not clog exhausting pipe 19 nor block communication hole 15. On top of that, PDP 1 can be exhausted in a shorter time, i.e. PDP 1 is exhausted in less than half of the time that is needed for the manufacturing steps having no gas adsorption member 20 to exhaust PDP 1 of air. PDP 1 thus manufactured has display characteristics equivalent to that manufactured without member 20.

In the manufacturing steps discussed above, gas adsorption member 20 placed in pedestal 19*a* is eventually activated by the heating, which softens binding member 19*b* for exhausting pipe 19 to be fixed to glass substrate 11. Therefore, in order to maintain the degassing effort of member 20 more effectively, it is preferable to put member 20 in an impurity gas atmosphere or vacuum atmosphere during the heating. This preparation allows achieving the PDP of higher performance.

In the exemplary embodiment discussed above, a PDP is taken as an example; however, the embodiment is applicable to any other display panels as long as their manufacturing steps employ a gas adsorption member in sealing and exhausting.

INDUSTRIAL APPLICABILITY

The present invention provides reliable PDPs excellent in video-display quality, and the PDPs are useful as a display device of a wall-hanging TV or a large-size monitoring device.

The invention claimed is:

1. A plasma display panel (PDP) comprising:

a pair of plates opposed to each other with an enclosed discharge space in between, and at least one of the plates having a communication hole communicating with inside of the PDP and with an exhaust pipe disposed outside of the PDP, the exhaust pipe including a connecting portion which connects the exhaust pipe to the at least one of the plates having the communication hole and a tubular portion, the connecting portion having a larger average inner diameter than an inner diameter of the tubular portion; and a gas adsorption member having one or more holes with cross section areas formed therein, the gas adsorption member being movable within the connecting portion of the exhaust pipe and having an outer diameter that is greater than the inner diameter of the tubular portion, wherein the one or more holes of the gas adsorption member have a combined total cross section area that is greater than a cross section area of the communication hole.

2. The PDP of claim 1, wherein the one or more holes of the gas adsorption member is a single hole and has a greater cross section area than an inner cross section area of the exhausting pipe.

3. The PDP of claim 1, wherein a size of the gas adsorption member is greater than an inner diameter of the exhausting pipe and a diameter of the communication hole.

4. The PDP of claim 1, wherein the one or more holes is a plurality of holes and a composite cross sectional area of the plurality of holes is greater than an inner cross section area of the exhausting pipe.

5. The PDP of claim 1, wherein the one or more holes includes at least two holes.

* * * * *